US006442981B1

(12) United States Patent
Augustsson

(10) Patent No.: US 6,442,981 B1
(45) Date of Patent: Sep. 3, 2002

(54) GASKET FOR A LAUNDRY WASHING MACHINE DOOR

(75) Inventor: Bengt Augustsson, Ljungby (SE)

(73) Assignee: Aktiebolaget Electrolux, Stockholm (SE)

( * ) Notice: Subject to any disclaimer, the term of this patent is extended or adjusted under 35 U.S.C. 154(b) by 112 days.

(21) Appl. No.: 09/703,124

(22) Filed: Oct. 31, 2000

(30) Foreign Application Priority Data

Nov. 5, 1999 (SE) ..... 9904027

(51) Int. Cl.[7] ..... D06F 37/00
(52) U.S. Cl. ..... 68/139
(58) Field of Search ..... 68/139, 24, 58

(56) References Cited

U.S. PATENT DOCUMENTS

| | | | | | |
|---|---|---|---|---|---|
| 2,650,490 | A | * | 9/1953 | Glassey | 68/139 |
| 2,657,475 | A | * | 11/1953 | Erickson | 68/139 X |
| 2,722,119 | A | * | 11/1955 | Constantine | 68/139 |
| 6,256,823 | B1 | * | 7/2001 | Kronbetter et al. | 68/139 X |

FOREIGN PATENT DOCUMENTS

| | | | | |
|---|---|---|---|---|
| DE | 1083219 | * | 6/1960 | 68/139 |
| DE | 2403705 | * | 1/1974 | 68/139 |
| FR | 1287987 | * | 2/1962 | 68/24 |
| GB | 1053462 | * | 1/1967 | 68/139 |

* cited by examiner

*Primary Examiner*—Philip Coe
(74) *Attorney, Agent, or Firm*—Pearne & Gordon LLP

(57) ABSTRACT

A gasket for a laundry washing machine door having a central opening provided with a glass (13). The gasket (15) includes first and second mainly U-shaped parts (15*a*, 15*b*) that are interconnected to one another. The first U-shaped part (15*a*) surrounds an edge of the door that borders on the opening. The second U-shaped part (15*b*) surrounding the edge of the glass (13). The second part has a tab (16) extending mainly perpendicular to a waist of the second part (15*b*) for abutting the door glass (13). An area between the waist and the tab supports a flange (17) extending toward an outer drum (18) of the laundry washing machine. An outer portion of the flange is provided with a sideways extending lip (20), as seen in a length direction of the flange (17) which, when the door is closed, seals against the drum (18).

16 Claims, 1 Drawing Sheet

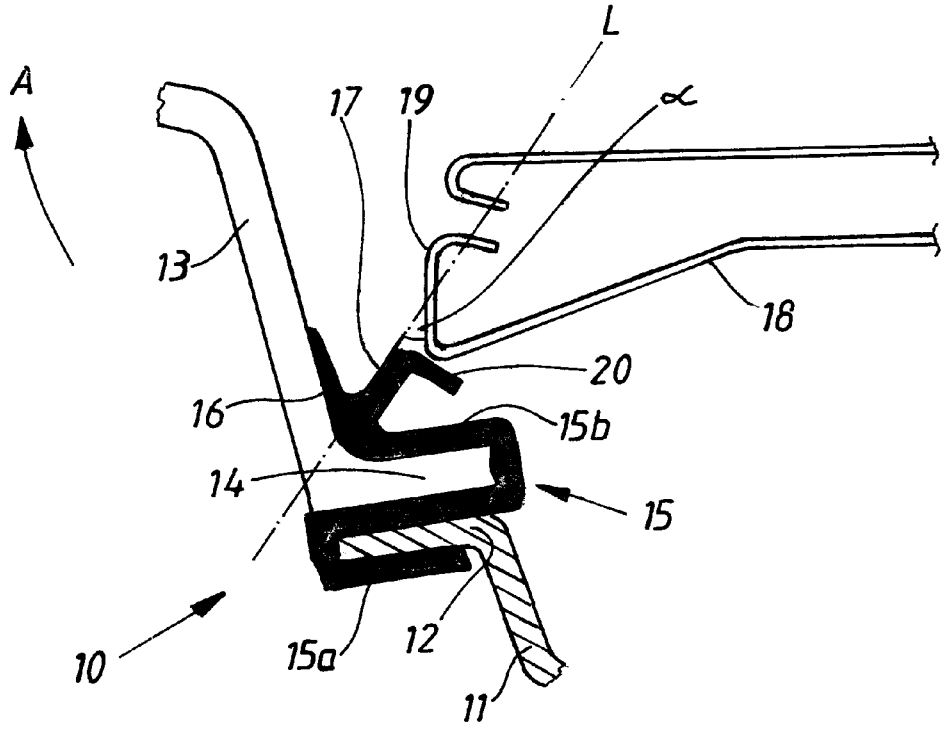
A
L
17
19
α
13
18
20
16
15b
14
15
10
15a
12
11

GASKET FOR A LAUNDRY WASHING MACHINE DOOR

BACKGROUND OF THE INVENTION

The present invention relates to a sealing gasket for sealing a central opening of a laundry washing machine door.

A gasket of the type mentioned above is previously known and is used for front loaded laundry washing machines in order to seal the abutting area between the door and the outer drum of the laundry washing machine, which outer drum during the washing procedure contains the washing liquid. Unfortunately, in order to achieve the necessary sealing effect, a high gasket pressure is necessary. This makes closing the door difficult. Moreover, the gasket has a tendency to become deformed when being acted on such that there develops an opening between the glass and the tab of the gasket, which means that there is a risk for leakage. A further disadvantage of the known arrangement is that there is a risk that dirt particles will stick between the gasket and the outer drum when the door is closed, which also means that leakage of cleaning liquid might occur.

SUMMARY OF THE INVENTION

The present invention is directed toward a gasket for which the drawbacks mentioned above are minimized or eliminated. The present invention is also directed toward a gasket having a smaller gasket pressure, which means that the door is easier to close at the same time as the sealing function of the door is safeguarded.

BRIEF DESCRIPTION OF THE DRAWING

These and further features of the present invention will be apparent with reference to the following description and drawing, wherein, in a section, illustrates a part of a laundry washing machine having a door and a gasket according to the invention, with the door being shown in a position immediately before being closed.

DETAILED DESCRIPTION OF THE PREFERRED EMBODIMENT

The door 10 shown in the figure comprises an outer door part 11, which is preferably made from sheet metal, such as aluminum. The outer door part has an inner flange 12 surrounding a central opening. The central opening is covered by a glass 13 or some other kind of transparent material. The glass 13 has a flange 14 that is generally parallel to the inner flange 12 of the outer door part 11.

The two flanges 11, 14 are surrounded by a gasket 15. The gasket 15 includes first and second U-shaped interconnected parts 15*a* and 15*b* such that the gasket forms a mainly Z-shaped structure defining a sealing between the door part 11 and the glass 13.

The gasket 15, which is preferably manufactured from rubber or plastic, for instance EPDM, comprises a tab 16 at the open end or waist of the second U-shaped part 15*b*, as illustrated. The tab 16 abuts the glass of the door and extends mainly perpendicular to lastmentioned waist. A thickness of the tab 16 decreases as the tab 16 extends away from the second U-shaped part 15*b*.

An area between the waist or outer end of the second U-shaped part 15*b* and the tab 16 supports a flange 17. The flange 17 extends at an angle of about 45° relative to a length direction of the waist and whose imagined extension line L, when the door is closed, meets a gasket abutting surface 19 of the outer drum 18 of the laundry washing machine at an acute angle a. The flange 17 is, at its outer part, provided with a transverse or sideways extending lip 20. The lip 20 extends toward the closed end of the second U-shaped part 15*b*. The lip 20 preferably has a thickness that is equal to or less than the thickness of the flange 17.

The gasket 15 works in the following way. When the door 10 of the laundry washing machine is closed i.e. when it is moved in the direction denoted A in the figure, the lip 20 will engage the outer drum 18. Continued pressing forces on the door 10 means that the lip 20, without greater resistance, will be folded towards the flange 17 and seal against the drum 18 at the same time as a moment is created on the flange 17. The moment presses the tab 16 against the glass. By this arrangement, the tab 16 will always abut the glass 13 such that leakage between the glass 13 and the tab 16 cannot occur. The arrangement also means that the sealing surface becomes self cleaning. Since the gasket is rubbed against the drum each time the door is opened and closed, the present arrangement is less susceptible to dirt particles sticking to the surface and causing leakage.

While the preferred embodiment of the present invention is shown and described herein, it is to be understood that the same is not so limited but shall cover and include any and all modifications thereof which fall within the purview of the invention.

What is claimed is:

1. A gasket for a laundry washing machine door having a central opening provided with a glass (13), the gasket (15) comprising first and second U-shaped parts (15*a*, 15*b*) that are connected to one another, the first U-shaped part (15*a*) surrounds an edge of the door that borders on the central opening and the second U-shaped part (15*b*) surrounds an edge of the glass (13), said second U-shaped part having a tab (16) extending mainly perpendicular to a waist of the second part (15*b*) and adapted for abutting engagement with the glass (13), an area between the waist and the tab supports a flange (17) that extends toward an outer drum (18) of the laundry washing machine, wherein an outer portion of the flange includes a lip (20), said lip being sideways-extending, as seen in a length direction of the flange (17), said lip, when the door is closed, seals against the drum (18).

2. The gasket according to claim 1, wherein the lip, when not being loaded, extends mainly 90° with respect to the length direction of the flange (17).

3. The gasket according to claim 2, wherein the flange (17) extends mainly 45° with respect to said waist.

4. The gasket according to claim 3, wherein a thickness of the lip (20) is less than or equal to a thickness of the flange (17).

5. A gasket according to claim 4, wherein the flange (17) is arranged such that, when the door is closed, an imagined extension line of the flange, as seen in a direction extending toward the drum (18), meets an abutting surface (19) of the drum (18) for the lip (20) at an acute angle ($\alpha$).

6. A gasket according to claim 4, wherein said gasket is manufactured in one piece and is formed from materials selected from the group consisting of rubber and plastic.

7. A gasket according to claim 3, wherein the flange (17) is arranged such that, when the door is closed, an imagined extension line of the flange, as seen in a direction extending toward the drum (18), meets an abutting surface (19) of the drum (18) for the lip (20) at an acute angle ($\alpha$).

8. A gasket according to claim 3, wherein said gasket is manufactured in one piece and is formed from materials selected from the group consisting of rubber and plastic.

9. The gasket according to claim 2, wherein a thickness of the lip (20) is less than or equal to a thickness of the flange (17).

10. A gasket according to claim 2, wherein the flange (17) is arranged such that, when the door is closed, an imagined extension line of the flange, as seen in a direction extending toward the drum (18), meets an abutting surface (19) of the drum (18) for the lip (20) at an acute angle ($\alpha$).

11. The gasket according to claim 1, wherein the flange (17) extends mainly 45° with respect to said waist.

12. The gasket according to claim 11, wherein a thickness of the lip (20) is less than or equal to a thickness of the flange (17).

13. A gasket according to claim 11, wherein the flange (17) is arranged such that, when the door is closed, an imagined extension line of the flange, as seen in a direction extending toward the drum (18), meets an abutting surface (19) of the drum (18) for the lip (20) at an acute angle ($\alpha$).

14. The gasket according to claim 1, wherein a thickness of the lip (20) is less than or equal to a thickness of the flange (17).

15. A gasket according to claim 1, wherein the flange (17) is arranged such that, when the door is closed, an imagined extension line of the flange, as seen in a direction extending toward the drum (18), meets an abutting surface (19) of the drum (18) for the lip (20) at an acute angle ($\alpha$).

16. A gasket according to claim 1, wherein said gasket is manufactured in one piece and is formed from materials selected from the group consisting of rubber and plastic.

* * * * *